US011066876B2

(12) United States Patent
Bonny

(10) Patent No.: US 11,066,876 B2
(45) Date of Patent: Jul. 20, 2021

(54) ROTATING/NON-ROTATING CASING CLEANING TOOL

(71) Applicant: Halliburton Energy Services, Inc., Houston, TX (US)

(72) Inventor: Brittany Morgan Bonny, Addison, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 68 days.

(21) Appl. No.: 16/493,704

(22) PCT Filed: Oct. 30, 2018

(86) PCT No.: PCT/US2018/058246
§ 371 (c)(1),
(2) Date: Sep. 12, 2019

(87) PCT Pub. No.: WO2020/091742
PCT Pub. Date: May 7, 2020

(65) Prior Publication Data

US 2021/0079735 A1 Mar. 18, 2021

(51) Int. Cl.

| | |
|---|---|
| ***E21B 37/02*** | (2006.01) |
| ***E21B 17/00*** | (2006.01) |
| ***E21B 12/06*** | (2006.01) |
| ***E21B 47/12*** | (2012.01) |

(52) U.S. Cl.
CPC ..... *E21B 12/06* (2013.01); *E21B 17/006* (2013.01); *E21B 37/02* (2013.01); *E21B 47/12* (2013.01)

(58) Field of Classification Search
CPC ..... E21B 37/02; E21B 37/10; E21B 17/006; E21B 17/1078; E21B 17/1035
See application file for complete search history.

(56) References Cited

U.S. PATENT DOCUMENTS 2,090,822 A * 8/1937 Wright ..... E21B 17/16 175/294
2,220,237 A * 11/1940 Hall ..... E21B 37/02 166/172

(Continued)

FOREIGN PATENT DOCUMENTS

WO 2017156322 9/2017

OTHER PUBLICATIONS

ISRWO International Search Report and Written Opinion for PCT/US2018/058246 dated Jul. 29, 2019.

(Continued)

*Primary Examiner* — Shane Bomar
(74) *Attorney, Agent, or Firm* — Scott Richardson; C. Tumey Law Group PLLC

(57) ABSTRACT

The present disclosure relates generally to wellbore cleanout and, more particularly, to an improved tool used to remove debris from an interior of a tubular string. The tool may comprise a number of combinations of varying subsystems able to customize the tool to the operator's needs. A cleaning tool may comprise a body, a first centralizer, wherein the first centralizer is disposed at a first end of the body, a second centralizer, wherein the second centralizer is disposed at a second end of the body, and at least one subsystem, wherein the at least one subsystem is disposed on the body.

20 Claims, 5 Drawing Sheets

(56) References Cited

U.S. PATENT DOCUMENTS

| | | | | |
|---|---|---|---|---|
| 2,334,788 | A * | 11/1943 | O'Leary | E21B 37/02 175/267 |
| 4,291,764 | A * | 9/1981 | Pampell | E21B 37/02 166/173 |
| 4,379,494 | A * | 4/1983 | Sheshtawy | E21B 17/1078 175/325.2 |
| 5,570,742 | A | 11/1996 | Reynolds et al. | |
| 6,655,462 | B1 * | 12/2003 | Carmichael | B08B 9/0553 166/173 |
| 6,851,472 | B2 | 2/2005 | Hern et al. | |
| 7,137,449 | B2 | 11/2006 | Silguero | |
| 7,311,141 | B2 * | 12/2007 | Tulloch | E21B 37/02 166/173 |
| 8,388,256 | B2 * | 3/2013 | Atkins | E21B 37/02 403/374.3 |
| 9,217,301 | B1 * | 12/2015 | Latham | E21B 17/16 |
| 9,512,696 | B2 | 12/2016 | Penisson | |
| 2011/0265988 | A1 * | 11/2011 | Hern | E21B 37/02 166/173 |
| 2012/0241145 | A1 | 9/2012 | Knobloch et al. | |
| 2014/0000900 | A1 * | 1/2014 | Leiper | E21B 17/006 166/311 |
| 2014/0116712 | A1 * | 5/2014 | Bansal | E21B 10/322 166/311 |
| 2017/0122072 | A1 | 5/2017 | Leiper et al. | |

OTHER PUBLICATIONS

Weatherford, Clearmax MAX-Combo tool, Wellbore Cleaning Services, 2016.
Schlumber, MultiBack Specialized Tools, 2011.
Halliburton, DrillTech® Deburr Mill, H011960, Aug. 2017.
Halliburton, Drill Tech® Casing Scraper, Rotational Scraper for Drilling and Cleanout Operations, H07621, Sep. 2017.
Halliburton, BristleTech® Brush, H07620 Aug. 2017.
Halliburton, ComboTech® Scraper/Brush, H07622 Aug. 2017.
Halliburton, MagTech® Casing Magnet, H07761 Sep. 2017.
Baker Hughes Trailblazer wellbore preparation tool, 2017.

* cited by examiner

ROTATING/NON-ROTATING CASING CLEANING TOOL

BACKGROUND

Wellbores drilled into subterranean formations may enable recovery of desirable fluids (e.g., hydrocarbons) using a number of different techniques. However, often the operations performed to extract the hydrocarbons create debris within the wellbore. This debris may buildup throughout the wellbore along a casing or tubular string. Further, the debris may interfere or contaminate future operations.

Typical post-completion clean-up operations may require multiple runs downhole with different tools. These tools may be rotational or non-rotational and may have pre-set components. It may be beneficial to provide a singular tool customized with any number of combinations of components, each component able to be rotational and/or non-rotational depending on the configuration with the body of the tool.

BRIEF DESCRIPTION OF THE DRAWINGS

These drawings illustrate certain aspects of some examples of the present disclosure, and should not be used to limit or define the disclosure.

DETAILED DESCRIPTION

The present disclosure relates generally to wellbore cleanout and, more particularly, to an improved tool used to remove debris from an interior of a tubular string. The tool may comprise a number of combinations of varying subsystems able to customize the tool to the operator's needs. In examples, an operator may be defined as an individual, group of individuals, or an organization.

Figure 1:
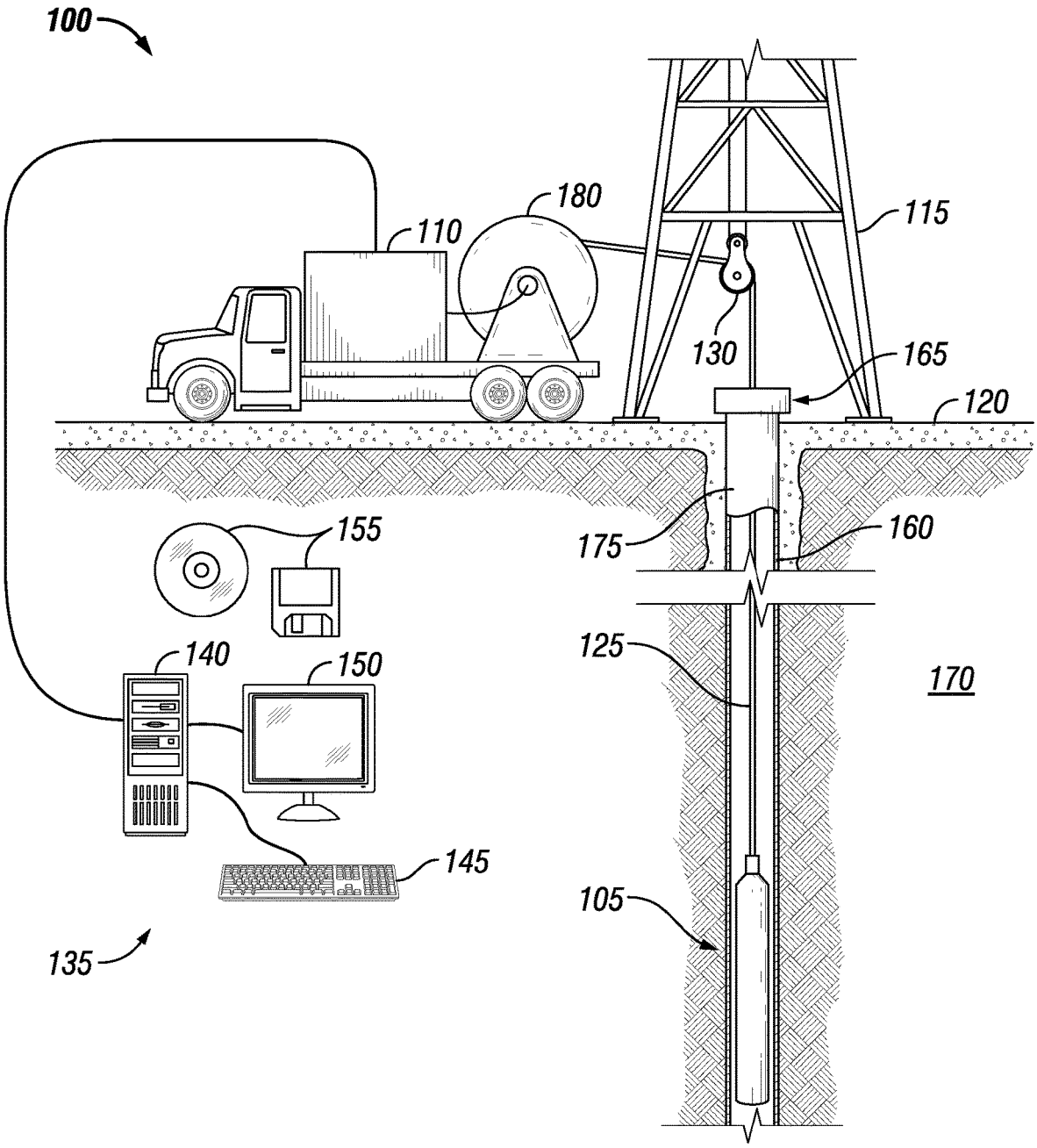
FIG. 1 illustrate an example of a well system.

FIG. 1 illustrates a cross-sectional view of a well system 100. As illustrated, well system 100 may comprise a cleaning tool 105 attached to a vehicle 110. In examples, it should be noted that cleaning tool 105 may not be attached to a vehicle 110 but may be attached to any other suitable object. Cleaning tool 105 may be supported by a rig 115 at a surface 120. Cleaning tool 105 may be tethered to vehicle 110 through a conveyance 125. Conveyance 125 may be disposed around one or more sheave wheels 130 located on vehicle 110. During operations, the one or more sheave wheels 130 may rotate to lower and/or raise conveyance 125 downhole. As cleaning tool 105 is coupled to conveyance 125, cleaning tool 105 may be displaced accordingly with conveyance 125. Conveyance 125 may include any suitable means for providing mechanical conveyance for cleaning tool 105 including, but not limited to, wireline, slickline, coiled tubing, pipe, drill pipe, tubular string, downhole tractor, and/or the like. In some embodiments, conveyance 125 may provide mechanical suspension, as well as electrical connectivity, for cleaning tool 105. In examples, cleaning tool 105 may be disposed about a downhole tool (not illustrated). Without limitations, the downhole tool may be any suitable downhole tool configured to perform a well completions operation and/or to obtain measurements while downhole. Information, such as measurements, from the downhole tool may be gathered and/or processed by an information handling system 135.

Systems and methods of the present disclosure may be implemented, at least in part, with information handling system 135. Information handling system 135 may include any instrumentality or aggregate of instrumentalities operable to compute, estimate, classify, process, transmit, receive, retrieve, originate, switch, store, display, manifest, detect, record, reproduce, handle, or utilize any form of information, intelligence, or data for business, scientific, control, or other purposes. For example, information handling system 135 may comprise a processing unit 140, a network storage device, or any other suitable device and may vary in size, shape, performance, functionality, and price. Information handling system 135 may include random access memory (RAM), one or more processing resources such as a central processing unit (CPU) or hardware or software control logic, ROM, and/or other types of nonvolatile memory. Additional components of the information handling system 135 may include one or more disk drives, one or more network ports for communication with external devices as well as various input and output (I/O) devices, such as an input device 145 (e.g., keyboard, mouse, etc.) and a video display 150. Information handling system 135 may also include one or more buses operable to transmit communications between the various hardware components.

Alternatively, systems and methods of the present disclosure may be implemented, at least in part, with non-transitory computer-readable media 155. Non-transitory computer-readable media 155 may include any instrumentality or aggregation of instrumentalities that may retain data and/or instructions for a period of time. Non-transitory computer-readable media 155 may include, for example, storage media such as a direct access storage device (e.g., a hard disk drive or floppy disk drive), a sequential access storage device (e.g., a tape disk drive), compact disk, CD-ROM, DVD, RAM, ROM, electrically erasable programmable read-only memory (EEPROM), and/or flash memory; as well as communications media such as wires, optical fibers, microwaves, radio waves, and other electromagnetic and/or optical carriers; and/or any combination of the foregoing.

As illustrated, cleaning tool 105 may be disposed in a wellbore 160 by way of conveyance 125. Wellbore 160 may extend from a wellhead 165 into a subterranean formation 170 from surface 120. Wellbore 160 may be cased or uncased. In examples, wellbore 160 may comprise a metallic material, such as a tubular string 175. By way of example, tubular string 175 may be a casing, liner, tubing, or other elongated tubular disposed in wellbore 160. As illustrated, wellbore 160 may extend through subterranean formation 170. Wellbore 160 may generally extend vertically into the subterranean formation 170. However, wellbore 160 may extend at an angle through subterranean formation 170, such as horizontal and slanted wellbores. For example, although wellbore 160 is illustrated as a vertical or low inclination angle well, high inclination angle or horizontal placement of the well and equipment may be possible. It should further be noted that while wellbore 160 is generally depicted as a land-based operation, those skilled in the art may recognize that the principles described herein are equally applicable to subsea operations that employ floating or sea-based platforms and rigs, without departing from the scope of the disclosure.

In examples, rig 115 includes a load cell (not shown) which may determine the amount of pull on conveyance 125 at surface 120 of wellbore 160. While not shown, a safety valve may control the hydraulic pressure that drives a drum 180 on vehicle 110 which may reel up and/or release conveyance 125 which may move cleaning tool 105 up and/or down wellbore 160. The safety valve may be adjusted to a pressure such that drum 180 may only impart a small amount of tension to conveyance 125 over and above the tension necessary to retrieve conveyance 125 and/or cleaning tool 105 from wellbore 160. The safety valve may typically be set a few hundred pounds above the amount of desired safe pull on conveyance 125 such that once that limit is exceeded, further pull on conveyance 125 may be prevented.

Figure 2:
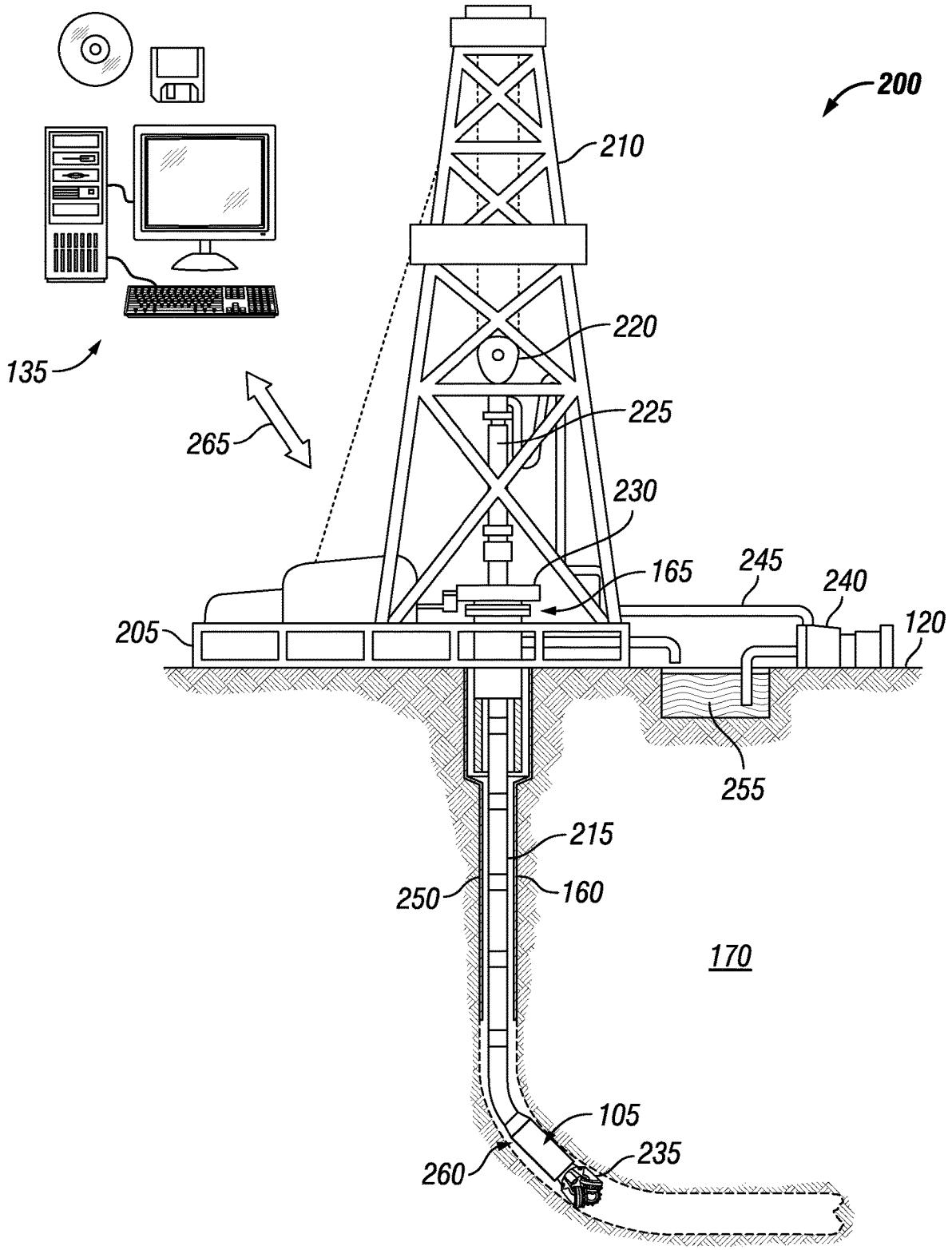
FIG. 2 illustrates an example of a drilling system.

FIG. 2 illustrates an example in which cleaning tool 105 may be included in a drilling system 200. As illustrated, wellbore 160 may extend from wellhead 165 into subterranean formation 170 from surface 120. A drilling platform 205 may support a derrick 210 having a traveling block 220 for raising and lowering a drill string 215. Drill string 215 may include, but is not limited to, drill pipe and/or coiled tubing, as generally known to those skilled in the art. A kelly 225 may support drill string 215 as it may be lowered through a rotary table 230. A drill bit 235 may be attached to the distal end of drill string 215 and may be driven either by a downhole motor and/or via rotation of drill string 215 at surface 120. Without limitation, drill bit 235 may include roller cone bits, PDC bits, natural diamond bits, any hole openers, reamers, coring bits, and/or the like. As drill bit 235 rotates, it may create and extend wellbore 160 to penetrate various subterranean formations 170. A pump 240 may circulate drilling fluid through a feed pipe 245 to kelly 225, downhole through the interior of drill string 215, through orifices in drill bit 235, back to surface 120 via an annulus 250 surrounding drill string 215, and into a retention pit 255.

With continued reference to FIG. 2, drill string 215 may begin at wellhead 165 and may traverse wellbore 160. Drill bit 235 may be attached to a distal end of drill string 215 and may be driven, for example, either by a downhole motor and/or via rotation of drill string 215 at surface 120. Drill bit 235 may be a part of a bottom hole assembly 260 at the distal end of drill string 215. Bottom hole assembly 260 may further comprise cleaning tool 105. Cleaning tool 105 may be disposed on the outside and/or within bottom hole assembly 260. As will be appreciated by those of ordinary skill in the art, bottom hole assembly 260 may be a measurement-while drilling (MWD) and/or logging-while-drilling (LWD) system.

Without limitation, bottom hole assembly 260 may be connected to and/or controlled by information handling system 135, which may be disposed on surface 120. Alternatively, information handling system 135 may be disposed downhole in bottom hole assembly 260. Processing of information recorded may occur downhole and/or on surface 120. Processing occurring downhole may be transmitted to surface 120 to be recorded, observed, and/or further analyzed. Additionally, information recorded on information handling system 135 that may be disposed downhole may be stored until bottom hole assembly 260 may be brought to surface 120. In examples, information handling system 135 may communicate with bottom hole assembly 260 through a communication line (not illustrated) disposed in (or on) drill string 215. In examples, wireless communication may be used to transmit information back and forth between information handling system 135 and bottom hole assembly 260. Information handling system 135 may transmit information to bottom hole assembly 260 and may receive, as well as process, information recorded by bottom hole assembly 260. In examples, a downhole information handling system (not illustrated) may include, without limitation, a microprocessor or other suitable circuitry, for estimating, receiving, and processing signals from bottom hole assembly 260. Downhole information handling system (not illustrated) may further include additional components, such as memory, input/output devices, interfaces, and the like. In examples, while not illustrated, bottom hole assembly 260 may include one or more additional components, such as analog-to-digital converter, filter and amplifier, among others, that may be used to process the measurements of bottom hole assembly 260 before they may be transmitted to surface 120. Alternatively, raw measurements from bottom hole assembly 260 may be transmitted to surface 120.

Any suitable technique may be used for transmitting signals from bottom hole assembly 260 to surface 120, including, but not limited to, wired pipe telemetry, mud-pulse telemetry, acoustic telemetry, and electromagnetic telemetry. While not illustrated, bottom hole assembly 260 may include a telemetry subassembly that may transmit telemetry data to surface 120. Without limitation, an electromagnetic source in the telemetry subassembly may be operable to generate pressure pulses in the drilling fluid that propagate along the fluid stream to surface 120. At surface 120, pressure transducers (not shown) may convert the pressure signal into electrical signals for a digitizer (not illustrated). The digitizer may supply a digital form of the telemetry signals to information handling system 135 via a communication link 265, which may be a wired or wireless link. The data may be analyzed and processed by information handling system 135.

Figure 3:
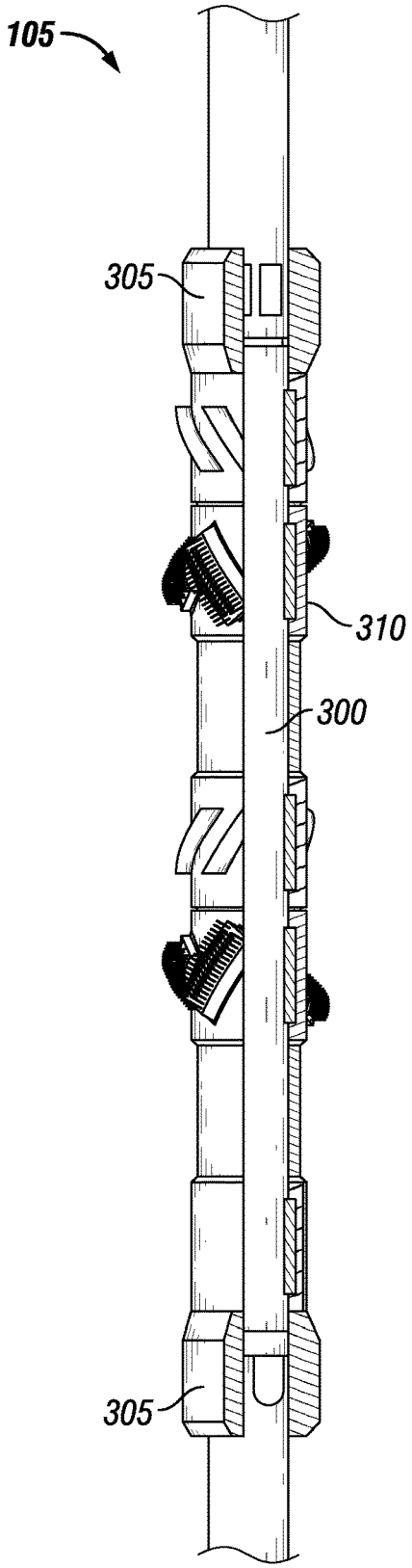
FIG. 3 illustrates an example of a cleaning tool.

FIG. 3 illustrates an example of cleaning tool 105. Concerning the present disclosure, cleaning tool 105 may be used to clean an interior of tubular string 175 (see FIG. 1). In examples, cleaning tool 105 may be incorporated into conveyance 125 (see FIG. 1) and disposed downhole into wellbore 160 (see FIG. 1) through tubular string 175, wherein tubular string 175 may be a casing or any other suitable tubular string. In some examples, at least a portion of cleaning tool 105 may come into contact with an interior of tubular string 175. As cleaning tool 105 displaces within wellbore 160, cleaning tool 105 may remove debris from the interior of tubular string 175.

Cleaning tool 105 may comprise a body 300, a centralizer 305, and a subsystem 310. Body 300 may be any suitable size, height, and/or shape. Without limitation, a suitable shape may include, but is not limited to, cross-sectional shapes that are circular, elliptical, triangular, rectangular, square, hexagonal, and/or combinations thereof. In examples, body 300 may be a hollow tubular. Without limitation, body 300 may comprise any suitable material such as metals, nonmetals, polymers, ceramics, and/or any combination thereof. Body 300 may be secured to conveyance 125 through the use of any suitable mechanisms, including, but not limited to, the use of suitable fasteners, threading, adhesives, welding, and/or combinations thereof. Without limitation, suitable fasteners may include nuts and bolts, washers, screws, pins, sockets, rods and studs, hinges and/or any combination thereof. In examples, body 300 may be a sleeve that slides over conveyance 125. In other examples, body 300 may clamp around conveyance 125.

As illustrated, centralizer 305 may be disposed at an end of body 300. There may be a plurality of centralizers 305 throughout cleaning tool 105. Alternatively, centralizer 305 may be disposed at any suitable location on body 300. In certain examples, centralizer 305 may be disposed at about a middle location of body 300 of cleaning tool 105. Centralizer 305 may serve to aid in guiding conveyance 125 while conveyance 125 is being disposed downhole into wellbore 160. Centralizer 305 may align conveyance 125 with a central axis of wellbore 160 so as to make conveyance 125 concentric with wellbore 160. Centralizer 305 may comprise a hinged collar (not illustrated) and bow-springs (not illustrated) to flex when a force is applied to centralizer 305. As the bow-springs flex, they may compress and displace radially outward to stabilize centralizer in a certain configuration.

Between the centralizers 305 disposed at the ends of body 300, there may be at least one subsystem 310 disposed onto body 300. In examples, there may be a plurality of subsystems 310. Subsystem 310 may be any suitable size, height, and/or shape. Without limitation, a suitable shape may include, but is not limited to, cross-sectional shapes that are circular, elliptical, triangular, rectangular, square, hexagonal, and/or combinations thereof. In examples, subsystem 310 may be a hollow tubular to be disposed around body 300. In examples, subsystem 310 may abut another subsystem 310 and/or centralizer 305. In other examples, there may be a pre-defined distance between subsystem 310 and another subsystem 310 and/or centralizer 305. Without limitations, the pre-defined distance may be from about 1 foot (0.31 m) to about 5 feet (1.55 m). Without limitation, subsystem 310 may comprise any suitable material such as metals, nonmetals, polymers, ceramics, and/or any combination thereof. Subsystem 310 may comprise components and/or tools used to remove debris from the interior of tubular string 175. Without limitations, the components and/or tools may be scraper blades, brushes, magnets, and/or combinations thereof.

Figure 4:
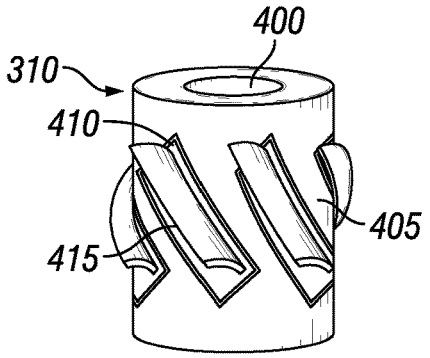
FIG. 4 illustrates an example of a subsystem.

FIG. 4 illustrates an example of subsystem 310. As illustrated, subsystem 310 may be a hollow tubular comprising a central bore 400 running the length of a subsystem body 405. There may be a plurality of slots 410 disposed along an exterior of subsystem body 405. The plurality of slots 410 may be any suitable size, height, and/or shape. In examples, the plurality of slots 410 may be disposed at an angle in relation to central bore 400. Without limitations, the plurality of slots 410 may be disposed parallel to central bore 400, wherein the angle between the plurality of slots 410 and central bore is zero degrees. Alternatively, the plurality of slots 410 may be disposed perpendicular to central bore 400, wherein the angle between the plurality of slots 410 and central bore is ninety degrees. In other examples, the plurality of slots 410 may be disposed at any angle between zero and ninety in relation to central bore 400. Without limitations, each slot 410 may have the same dimensions. Alternatively, the plurality of slots 410 may have different dimensions. The plurality of slots 410 may be rectangular areas of missing material from subsystem body 405 configured to secure a scraper blade 415 to subsystem body 405. In examples, a plurality of scraper blades 415 may be disposed in the plurality of slots 410, each slot 410 receiving a single scraper blade 415. In certain examples, a designated portion of the plurality of slots 410 may receive a scraper blade 415. The designated portion of the plurality of slots 410 that does not receive a scraper blade 415 may remain empty. Without limitations, a fraction of the plurality of slots 410, such as a half, a third, a fourth, a fifth, etc. may remain empty. In examples, the plurality of scraper blades 415 may be removable or non-removable from the plurality of slots 410. Without limitation, each scraper blade 415 may comprise any suitable material such as metals, nonmetals, polymers, ceramics, and/or any combination thereof. Each scraper blade 415 may be any suitable size, height, and/or shape. In examples, the plurality of scraper blades 415 may have the same dimensions. In other examples, the plurality of scraper blades 415 may have different dimensions. The plurality of scraper blades 415 may protrude outward from subsystem body 405 and come into contact with the interior of tubular string 175 (see FIG. 1). As cleaning tool 105 (see FIG. 3) displaces throughout wellbore 160 (see FIG. 1), the plurality of scraper blades 415 may scrape off debris from the interior of tubular string 175. In certain examples, the plurality of scraper blades 415 may be spring-loaded so as to apply a consistent force against the interior of tubular string 175.

Figure 5:
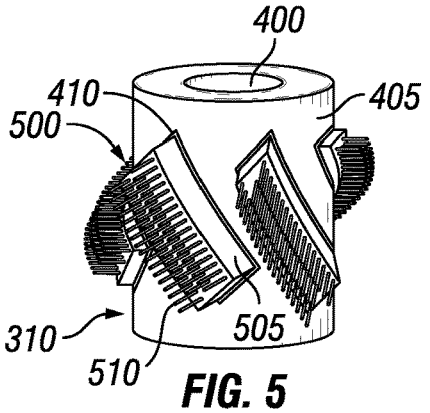
FIG. 5 illustrates an example of a subsystem.

FIG. 5 illustrates another example of subsystem 310. As illustrated, subsystem 310 may be a hollow tubular comprising central bore 400 running the length of subsystem body 405. The plurality of slots 410 may be disposed along an exterior of subsystem body 405. The plurality of slots 410 may be any suitable size, height, and/or shape. In examples, the plurality of slots 410 may be disposed at an angle in relation to central bore 400. Without limitations, the plurality of slots 410 may be disposed parallel to central bore 400, wherein the angle between the plurality of slots 410 and central bore is zero degrees. Alternatively, the plurality of slots 410 may be disposed perpendicular to central bore 400, wherein the angle between the plurality of slots 410 and central bore is ninety degrees. In other examples, the plurality of slots 410 may be disposed at any angle between zero and ninety in relation to central bore 400. Without limitations, each slot 410 may have the same dimensions. Alternatively, the plurality of slots 410 may have different dimensions. The plurality of slots 410 may be rectangular areas of missing material from subsystem body 405 configured to secure a brush 500 to subsystem body 405. In examples, a plurality of brushes 500 may be disposed in the plurality of slots 410, each slot 410 receiving a single brush 500. In certain examples, a designated portion of the plurality of slots 410 may receive a brush 500. In examples, the plurality of brushes 500 may be removable or non-removable from the plurality of slots 410. Without limitation, each brush 500 may comprise any suitable material such as metals, nonmetals, polymers, ceramics, and/or any combination thereof. Each brush 500 may be any suitable size, height, and/or shape. In examples, the plurality of brushes 500 may have the same dimensions. In other examples, the plurality of brushes 500 may have different dimensions. The plurality of brushes 500 may protrude outward from subsystem body 405 and come into contact with the interior of tubular string 175 (see FIG. 1). As cleaning tool 105 (see FIG. 3) displaces throughout wellbore 160 (see FIG. 1), the plurality of brushes 500 may remove debris from the interior of tubular string 175. Each brush 500 may comprise a brush body 505 and bristles 510. Brush body 505 may have complimentary dimensions to slot 410 so as to be disposed into slot 410. Bristles 510 may serve to rub against the interior of tubular string 175. Without limitations, bristles 510 may comprise any suitable material such as metals, nonmetals, polymers, ceramics, and/or any combination thereof.

Figure 6:
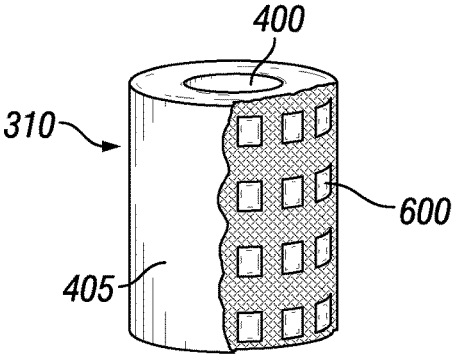
FIG. 6 illustrates an example of a subsystem.

FIG. 6 illustrates a partial cross-section of another example of subsystem 310. As illustrated, subsystem 310 may be a hollow tubular comprising central bore 400 running the length of subsystem body 405. Subsystem body 405 may comprise a plurality of magnets 600. Alternatively, subsystem body 405 may comprise a single magnet 600. The plurality of magnets 600 may be disposed exterior to subsystem body 405, within subsystem body 405, interior to subsystem body 405, and/or combinations thereof. Each magnet 600 may be any suitable size, height, and/or shape. Without limitation, each magnet 600 may comprise any suitable material, such as neodymium, samarium, and/or cobalt, which may produce a magnetic field. In examples, the plurality of magnets 600 may operate to produce a magnetic field so as to attract ferromagnetic debris from the interior of tubular string 175 (see FIG. 1).

Figure 7:
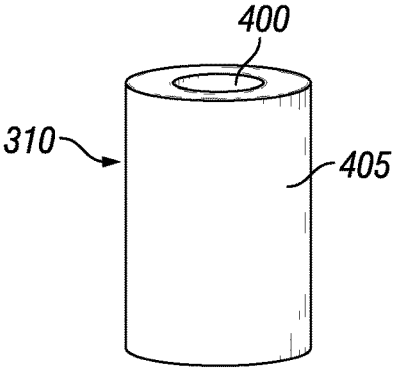
FIG. 7 illustrates an example of a subsystem.

FIG. 7 illustrates another example of subsystem 310. As illustrated, subsystem 310 may be a hollow tubular comprising central bore 400 running the length of subsystem body 405. In this particular example, subsystem 310 may not comprise any additional components and/or tools on subsystem body 405 and may serve as a spacer. The spacer may separate consecutive subsystems 310 and/or centralizers 305 by a specific distance, wherein that distance is the length of the spacer.

Figure 9:
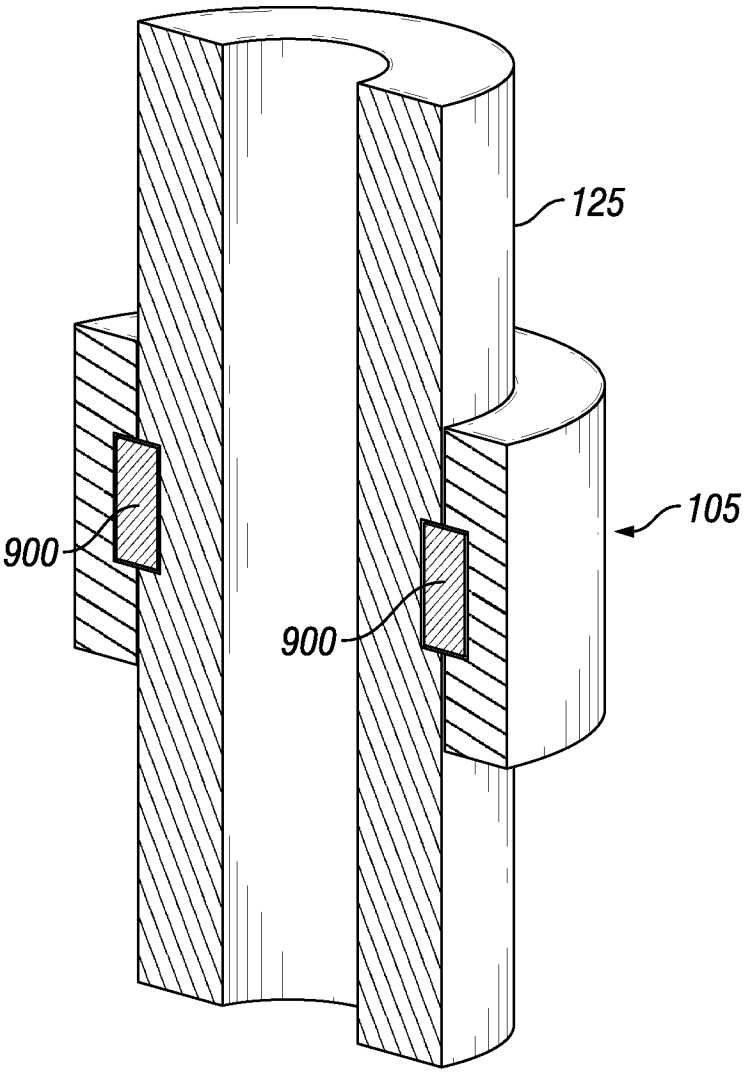
FIG. 9 illustrates an example of a cleaning tool disposed around a conveyance with a key.
Figure 8:
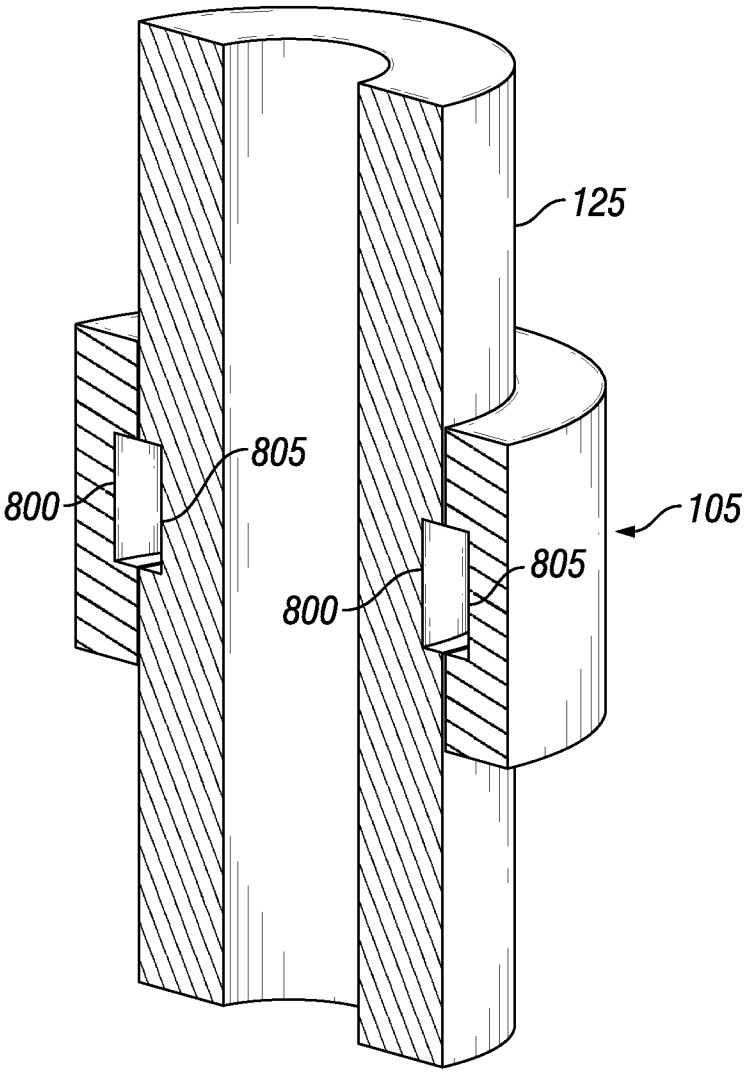
FIG. 8 illustrates an example of a cleaning tool disposed around a conveyance.
Figure 11:
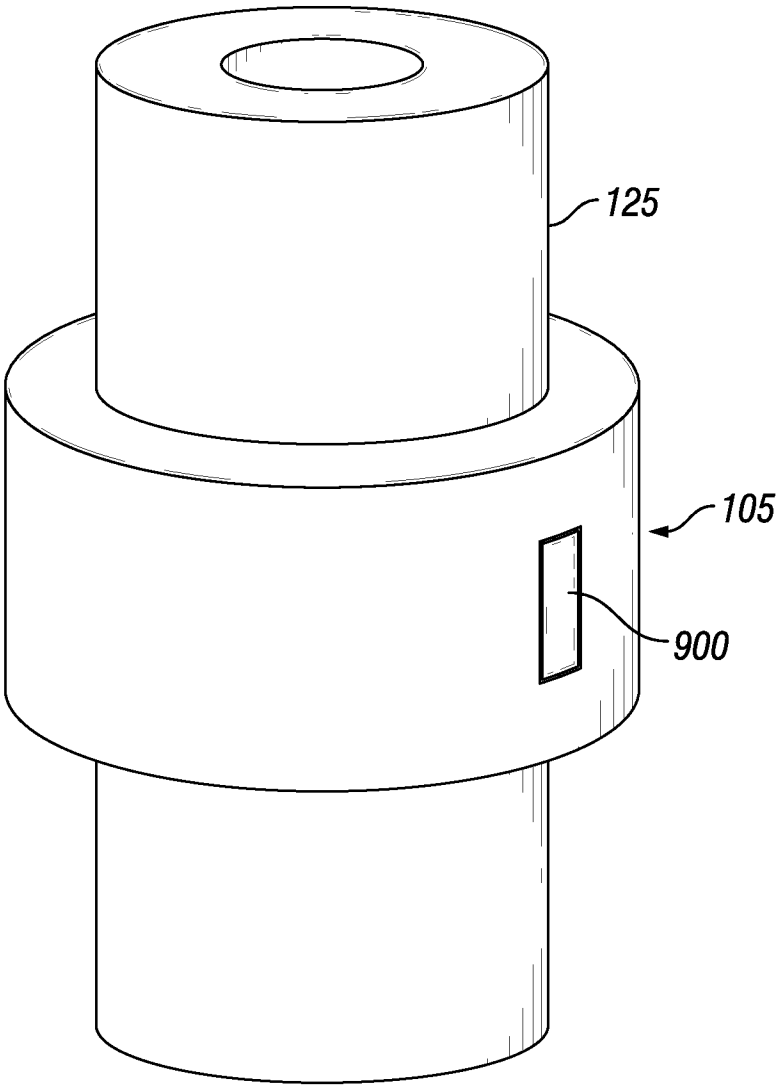
FIG. 11 illustrates an example of a cleaning tool disposed around a conveyance with a key.
Figure 10:
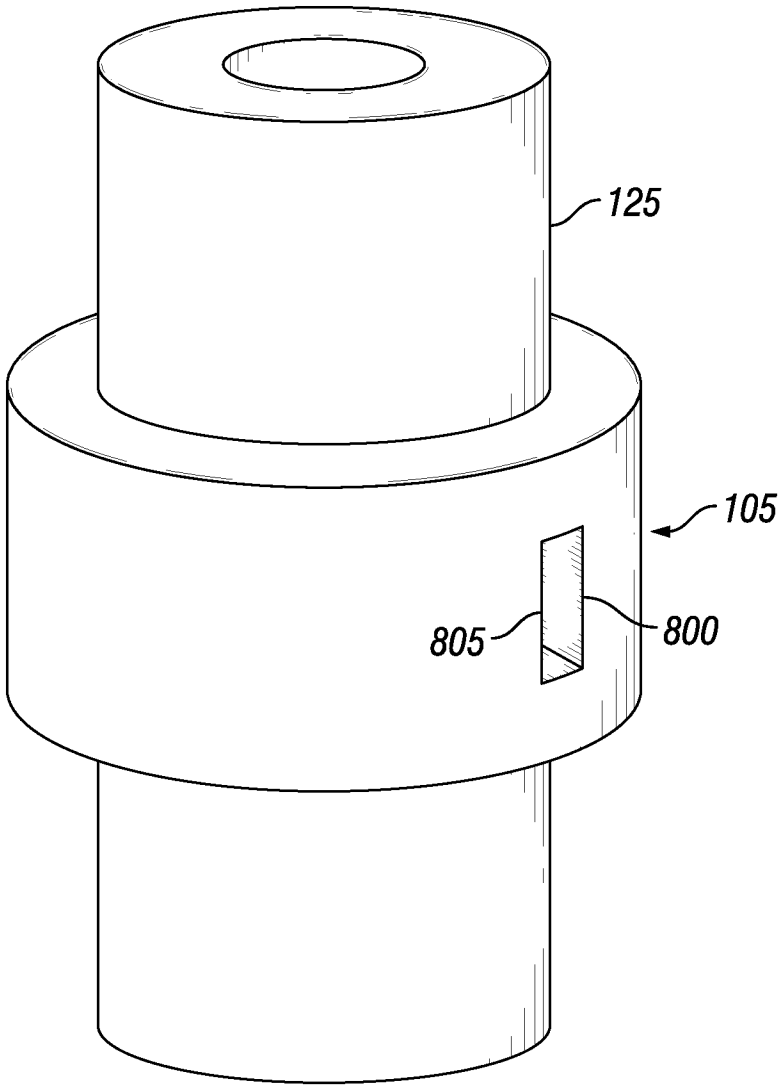
FIG. 10 illustrates an example of a cleaning tool disposed around a conveyance.

FIGS. 8-11 illustrate example couplings of cleaning tool 105 to conveyance 125. FIGS. 8 and 10 illustrate cleaning tool 105 disposed around conveyance 125, wherein cleaning tool 105 may be able to freely rotate around conveyance 125. FIGS. 9 and 11 illustrated cleaning tool 105 disposed around and coupled to conveyance 125, wherein cleaning tool 105 may be non-rotational with respect to conveyance 125. In examples, there may be a conveyance recess 800 disposed on an exterior portion of conveyance 125. Conveyance recess 800 may be any suitable size, height, and/or shape. In further examples, there may be a cleaning tool recess 805 disposed on an interior portion of cleaning tool 105. Cleaning tool recess 805 may be any suitable size, height, and/or shape. Conveyance recess 800 and cleaning tool recess 805 may be adjacent to each other as cleaning tool 105 is disposed around conveyance 125 (as best seen in FIGS. 8 and 10). Conveyance recess 800 and cleaning tool recess 805 may collectively form a designated opening configured to receive a key 900 (as best seen in FIGS. 9 and 11). A key 900 may be any suitable size, height, and/or shape and may be made from any suitable material. Key 900 may serve to rigidly couple cleaning tool 105 to conveyance 125 by restricting the relative rotation between the two when key 900 is disposed within the designated opening formed by conveyance recess 800 and cleaning tool recess 805. When key 900 is not disposed within the designated opening formed by conveyance recess 800 and cleaning tool recess 805, cleaning tool 105 may be able to freely rotate around conveyance 125. In examples, there may be a plurality of cleaning tool recesses 805 disposed within cleaning tool 105 that align with a plurality of conveyance recesses 800. In certain examples, each individual subsystem 310 (see FIG. 3) may comprise a cleaning tool recess 805 that aligns with a corresponding conveyance recess 800.

This method and system may include any of the various features of the compositions, methods, and system disclosed herein, including one or more of the following statements.

Statement 1. A cleaning tool, comprising: a body; a first centralizer, wherein the first centralizer is disposed at a first end of the body; a second centralizer, wherein the second centralizer is disposed at a second end of the body; and at least one subsystem, wherein the at least one subsystem is disposed on the body.

Statement 2. The cleaning tool of statement 1, wherein the at least one subsystem comprises a plurality of slots and a plurality of scraper blades.

Statement 3. The cleaning tool of statement 2, wherein the plurality of scraper blades are disposed within the plurality of slots, and further wherein the plurality of scraper blades contact an interior of a tubular string.

Statement 4. The cleaning tool of statement 2, wherein the plurality of scraper blades are spring-loaded.

Statement 5. The cleaning tool of statement 2, wherein the plurality of scraper blades are removable from the plurality of slots.

Statement 6. The cleaning tool of any of the previous statements, wherein the at least one subsystem comprises a plurality of slots and a plurality of brushes.

Statement 7. The cleaning tool of statement 6, wherein the plurality of brushes each comprise a brush body and bristles, wherein each brush body is disposed within each slot, and further wherein the bristles of the plurality of brushes contact an interior of a tubular string.

Statement 8. The cleaning tool of statement 7, wherein each brush body is removable from each slot.

Statement 9. The cleaning tool of any of the previous statements, wherein the at least one subsystem comprises a plurality of magnets disposed within a body of the subsystem.

Statement 10. The cleaning tool of any of the previous statements, wherein the at least one subsystem comprises a single magnet.

Statement 11. The cleaning tool of any of the previous statements, wherein the at least one subsystem is a spacer.

Statement 12. The cleaning tool of any of the previous statements, wherein the cleaning tool comprises a plurality of subsystems.

Statement 13. The cleaning tool of any of the previous statements, further comprising a cleaning tool recess, wherein the cleaning tool aligns with a conveyance to dispose the cleaning tool recess adjacent to a conveyance recess.

Statement 14. The cleaning tool of statement 13, wherein the cleaning tool recess and the conveyance recess are configured to form an opening to receive a key.

Statement 15. The cleaning tool of statement 14, wherein the key is disposed within the opening to restrict relative rotation between the cleaning tool and the conveyance.

Statement 16. A method of cleaning a wellbore, comprising: attaching a cleaning tool to a conveyance, wherein the cleaning tool comprises: a body; a first centralizer, wherein the first centralizer is disposed at a first end of the body; a second centralizer, wherein the second centralizer is disposed at a second end of the body; and at least one subsystem, wherein the at least one subsystem is disposed on the body; disposing the cleaning tool downhole into the wellbore; and removing debris from an interior of a tubular string disposed within the wellbore.

Statement 17. The method of statement 16, wherein the at least one subsystem comprises a plurality of slots and a plurality of scraper blades, wherein the plurality of scraper blades are disposed within the plurality of slots, and further wherein the plurality of scraper blades contact the interior of the tubular string.

Statement 18. The method of statement 16 or 17, wherein the at least one subsystem comprises a plurality of slots and a plurality of brushes, wherein the plurality of brushes each comprise a brush body and bristles, wherein each brush body is disposed within each slot, and further wherein the bristles of the plurality of brushes contact the interior of the tubular string.

Statement 19. The method of any one of statements 16 to 18, wherein the at least one subsystem comprises a plurality of magnets disposed within a body of the at least one subsystem.

Statement 20. The method of any one of statements 16 to 19, wherein attaching the cleaning tool to the conveyance comprises of disposing a key within an opening configured to restrict the relative rotation between the cleaning tool and the conveyance.

The preceding description provides various examples of the systems and methods of use disclosed herein which may contain different method steps and alternative combinations of components. It should be understood that, although individual examples may be discussed herein, the present disclosure covers all combinations of the disclosed examples, including, without limitation, the different component combinations, method step combinations, and properties of the system. It should be understood that the compositions and methods are described in terms of "comprising," "containing," or "including" various components or steps, the compositions and methods can also "consist essentially of" or "consist of" the various components and steps. Moreover, the indefinite articles "a" or "an," as used in the claims, are defined herein to mean one or more than one of the element that it introduces.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present examples are well adapted to attain the ends and advantages mentioned as well as those that are inherent therein. The particular examples disclosed above are illustrative only, and may be modified and practiced in different but equivalent manners apparent to those skilled in the art having the benefit of the teachings herein. Although individual examples are discussed, the disclosure covers all combinations of all of the examples. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative examples disclosed above may be altered or modified and all such variations are considered within the scope and spirit of those examples. If there is any conflict in the usages of a word or term in this specification and one or more patent(s) or other documents that may be incorporated herein by reference, the definitions that are consistent with this specification should be adopted.

What is claimed is:

1. A cleaning tool, comprising:

a body;

a first centralizer, wherein the first centralizer is disposed at a first end of the body;

a second centralizer, wherein the second centralizer is disposed at a second end of the body;

at least one subsystem, wherein the at least one subsystem is disposed on the body, and wherein the at least one subsystem comprises a plurality of slots, wherein a first slot includes a removable component, wherein a second slot is empty, wherein each slot extends lengthwise along the body and is angled relative to a central bore of the body.

2. A cleaning tool, comprising:

a body;

a first centralizer, wherein the first centralizer is disposed at a first end of the body;

a second centralizer, wherein the second centralizer is disposed at a second end of the body;

at least one subsystem, wherein the at least one subsystem is disposed on the body, and wherein the at least one subsystem comprises a plurality of slots, wherein a first slot includes a removable component, wherein a second slot is empty, wherein the removable component comprises a scraper blade.

3. The cleaning tool of claim 2, wherein the scraper blade is operable to contact an interior of a tubular string.

4. The cleaning tool of claim 2, wherein the scraper blade is spring-loaded.

5. The cleaning tool of claim 2, wherein the scraper blade is removable from the first slot.

6. The cleaning tool of claim 1, wherein the removable component comprises a brush.

7. The cleaning tool of claim 6, wherein the brush comprises a brush body and bristles, wherein the brush body is disposed within the first slot, and further wherein the bristles are operable to contact an interior of a tubular string.

8. The cleaning tool of claim 7, wherein the brush body is removable from the first slot.

9. The cleaning tool of claim 1, wherein the at least one subsystem further comprises a plurality of magnets disposed within a body of the subsystem.

10. The cleaning tool of claim 1, wherein the at least one subsystem further comprises a single magnet.

11. The cleaning tool of claim 1, wherein the at least one subsystem comprises a spacer.

12. The cleaning tool of claim 1, wherein the cleaning tool further comprises a plurality of subsystems.

13. The cleaning tool of claim 1, further comprising a cleaning tool recess, wherein the cleaning tool aligns with a conveyance to dispose the cleaning tool recess adjacent to a conveyance recess.

14. The cleaning tool of claim 13, wherein the cleaning tool recess and the conveyance recess are configured to form an opening to receive a key.

15. The cleaning tool of claim 14, wherein the key is disposed within the opening to restrict relative rotation between the cleaning tool and the conveyance.

16. A method of cleaning a wellbore, comprising:

attaching a cleaning tool to a conveyance, wherein the cleaning tool comprises:

a body;

a first centralizer, wherein the first centralizer is disposed at a first end of the body;

a second centralizer, wherein the second centralizer is disposed at a second end of the body; and at least one subsystem, wherein the at least one subsystem is disposed on the body;

disposing the cleaning tool downhole into the wellbore, wherein the at least one subsystem comprises a plurality of slots, wherein a first slot includes a removable component, wherein a second slot is empty, wherein each slot extends lengthwise along the body and is angled relative to a central bore of the body; and removing debris from an interior of a tubular string disposed within the wellbore.

17. A method of cleaning a wellbore, comprising:

attaching a cleaning tool to a conveyance, wherein the cleaning tool comprises:

a body;

a first centralizer, wherein the first centralizer is disposed at a first end of the body;

a second centralizer, wherein the second centralizer is disposed at a second end of the body; and at least one subsystem, wherein the at least one subsystem is disposed on the body;

disposing the cleaning tool downhole into the wellbore, wherein the at least one subsystem comprises a plurality of slots, wherein a first slot includes a removable component, wherein a second slot is empty, wherein the removable component comprises a scraper blade that is operable to contact the interior of the tubular string; and removing debris from an interior of a tubular string disposed within the wellbore.

18. The method of claim 16, wherein the removable component comprises a brush, wherein the brush comprises a brush body and bristles, wherein the brush body is disposed within the first slot, and further wherein the bristles are operable to contact the interior of the tubular string.

19. The method of claim 16, wherein the at least one subsystem further comprises a plurality of magnets disposed within a body of the at least one subsystem.

20. The method of claim 16, wherein attaching the cleaning tool to the conveyance comprises of disposing a key within an opening configured to restrict the relative rotation between the cleaning tool and the conveyance.

* * * * *